US009878421B2

(12) United States Patent
Yavelberg

(10) Patent No.: US 9,878,421 B2
(45) Date of Patent: Jan. 30, 2018

(54) CHEMICAL MECHANICAL POLISHING RETAINING RING WITH INTEGRATED SENSOR

(71) Applicant: APPLIED MATERIALS, INC., Santa Clara, CA (US)

(72) Inventor: Simon Yavelberg, Cupertino, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 250 days.

(21) Appl. No.: 14/720,047

(22) Filed: May 22, 2015

(65) Prior Publication Data

US 2015/0360343 A1 Dec. 17, 2015

Related U.S. Application Data

(60) Provisional application No. 62/012,812, filed on Jun. 16, 2014.

(51) Int. Cl.

| | |
|---|---|
| ***B24B 37/32*** | (2012.01) |
| ***B24B 37/005*** | (2012.01) |
| ***B24B 49/16*** | (2006.01) |
| ***B24B 49/00*** | (2012.01) |

(52) U.S. Cl.

CPC ..... *B24B 37/32* (2013.01); *B24B 37/005* (2013.01); *B24B 49/003* (2013.01); *B24B 49/16* (2013.01)

(58) Field of Classification Search

CPC ..... B24B 37/04; B24B 37/30; B24B 37/32; B24B 41/061; B24B 49/003

See application file for complete search history.

(56) References Cited

U.S. PATENT DOCUMENTS

| | | | | |
|---|---|---|---|---|
| 5,222,329 | A | 6/1993 | Yu | |
| 6,623,329 | B1 * | 9/2003 | Moore | B24B 37/30 451/287 |
| 6,939,202 | B2 * | 9/2005 | Heidrich | B24B 37/32 451/21 |
| 9,242,341 | B2 * | 1/2016 | Lin | B24B 37/005 |
| 9,511,474 | B2 * | 12/2016 | Lin | B24B 37/005 |
| 2005/0142987 | A1 | 6/2005 | Kramer et al. | |
| 2006/0172662 | A1 | 8/2006 | Lim et al. | |
| 2007/0032171 | A1 | 2/2007 | Chandrasekaran | |
| 2012/0184189 | A1 * | 7/2012 | Kim | B24B 37/30 451/388 |
| 2013/0210173 | A1 | 8/2013 | Wu et al. | |
| 2014/0260624 | A1 | 9/2014 | Subrahmanyam et al. | |

FOREIGN PATENT DOCUMENTS

JP 2001-287161 A 10/2001

OTHER PUBLICATIONS

International Search Report and Written Opinion dated Aug. 31, 2015 for PCT Application No. PCT/US2015/032818.

* cited by examiner

*Primary Examiner* — Timothy V Eley
(74) *Attorney, Agent, or Firm* — Moser Taboada; Alan Taboada

(57) ABSTRACT

A retaining ring for a chemical mechanical polishing carrier head having a mounting surface for a substrate is provided herein. In some embodiments, the retaining ring may include an annular body have a central opening, a channel formed in the body, wherein a first end of the channel is proximate the central opening, and a sensor disposed within the channel and proximate the first end, wherein the sensor is configured to detect acoustic and/or vibration emissions from processes performed on the substrate.

18 Claims, 6 Drawing Sheets

CHEMICAL MECHANICAL POLISHING RETAINING RING WITH INTEGRATED SENSOR

CROSS-REFERENCE TO RELATED APPLICATIONS

This application claims benefit of U.S. provisional patent application Ser. No. 62/012,812, filed Jun. 16, 2014, which is herein incorporated by reference in its entirety.

FIELD

Embodiments of the present disclosure generally relate to chemical mechanical polishing (CMP) of substrates.

BACKGROUND

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly non-planar. This non-planar surface presents problems in the photolithographic steps of the integrated circuit fabrication process. Thus, there is a need to periodically planarize the substrate surface.

Chemical mechanical polishing (CMP) is one accepted method of planarization. During planarization, the substrate is typically mounted on a carrier or polishing head. The exposed surface of the substrate is placed against a rotating polishing pad. The polishing pad may be either a "standard" or a fixed-abrasive pad. A standard polishing pad has durable roughened surface, whereas a fixed-abrasive pad has abrasive particles held in a containment media. The carrier head provides a controllable load, i.e., pressure, on the substrate to push the substrate against the polishing pad. A polishing slurry, including at least one chemically-reactive agent, and abrasive particles, if a standard pad is used, is supplied to the surface of the polishing pad.

The effectiveness of a CMP process may be measured by the CMP process's polishing rate, and by the resulting finish (absence of small-scale roughness) and flatness (absence of large-scale topography) of the substrate surface. The polishing rate, finish and flatness are determined by the pad and slurry combination, the relative speed between the substrate and pad, and the force pressing the substrate against the pad.

The CMP retaining ring functions to retain the substrate during polish. The CMP retaining ring also allows slurry transport under the substrate and affects edge performance for uniformity. However, typical CMP retaining rings have no integrated sensors that can be used for closed loop control during process, diagnostics or providing feedback on the endpoint of chemical-mechanical polishing processes and catastrophic events, such as for example, substrate breakage or slip out.

Therefore, the inventor believes that structures and methods that accomplish accurate and reliable detection of the endpoint of chemical-mechanical polishing processes and catastrophic events are desirable.

SUMMARY

A retaining ring for a chemical mechanical polishing carrier head having a mounting surface for a substrate is provided herein. In some embodiments, the retaining ring may include an annular body have a central opening, a channel formed in the body, wherein a first end of the channel is proximate the central opening, and a sensor disposed within the channel and proximate the first end, wherein the sensor is configured to detect acoustic and/or vibration emissions from processes performed on the substrate.

In some embodiments, a carrier head for a chemical mechanical polishing apparatus may include a base, a retaining ring connected to the base, wherein the retaining ring includes an annular body have a central opening, a channel formed in the body, wherein a first end of the channel is proximate the central opening, and a sensor disposed within the channel and proximate the first end, wherein the sensor is configured to detect acoustic and/or vibration emissions from chemical mechanical polishing processes, a support structure connected to the base by a flexure to be moveable independently of the base and the retaining ring, and a flexible membrane that defines a boundary of a pressurizable chamber, the membrane connected to the support structure and having a mounting surface for a substrate.

In some embodiments, a method for determining chemical mechanical polishing conditions may include providing a retaining ring having an integrated sensor in a chemical mechanical polishing apparatus, performing a chemical mechanical polishing process on a substrate disposed in the chemical mechanical polishing apparatus, capturing, via the sensor, acoustic and/or vibration emissions from the chemical mechanical polishing process performed, transmitting information associated with the captured acoustic and/or vibration emissions, and determining a chemical mechanical polishing condition based on an analysis of the transmitted information.

Other and further embodiments of the present disclosure are described below.

BRIEF DESCRIPTION OF THE DRAWINGS

Embodiments of the present disclosure, briefly summarized above and discussed in greater detail below, can be understood by reference to the illustrative embodiments of the disclosure depicted in the appended drawings. It is to be noted, however, that the appended drawings illustrate only typical embodiments of this disclosure and are therefore not to be considered limiting of its scope, for the disclosure may admit to other equally effective embodiments.

Figure 1:
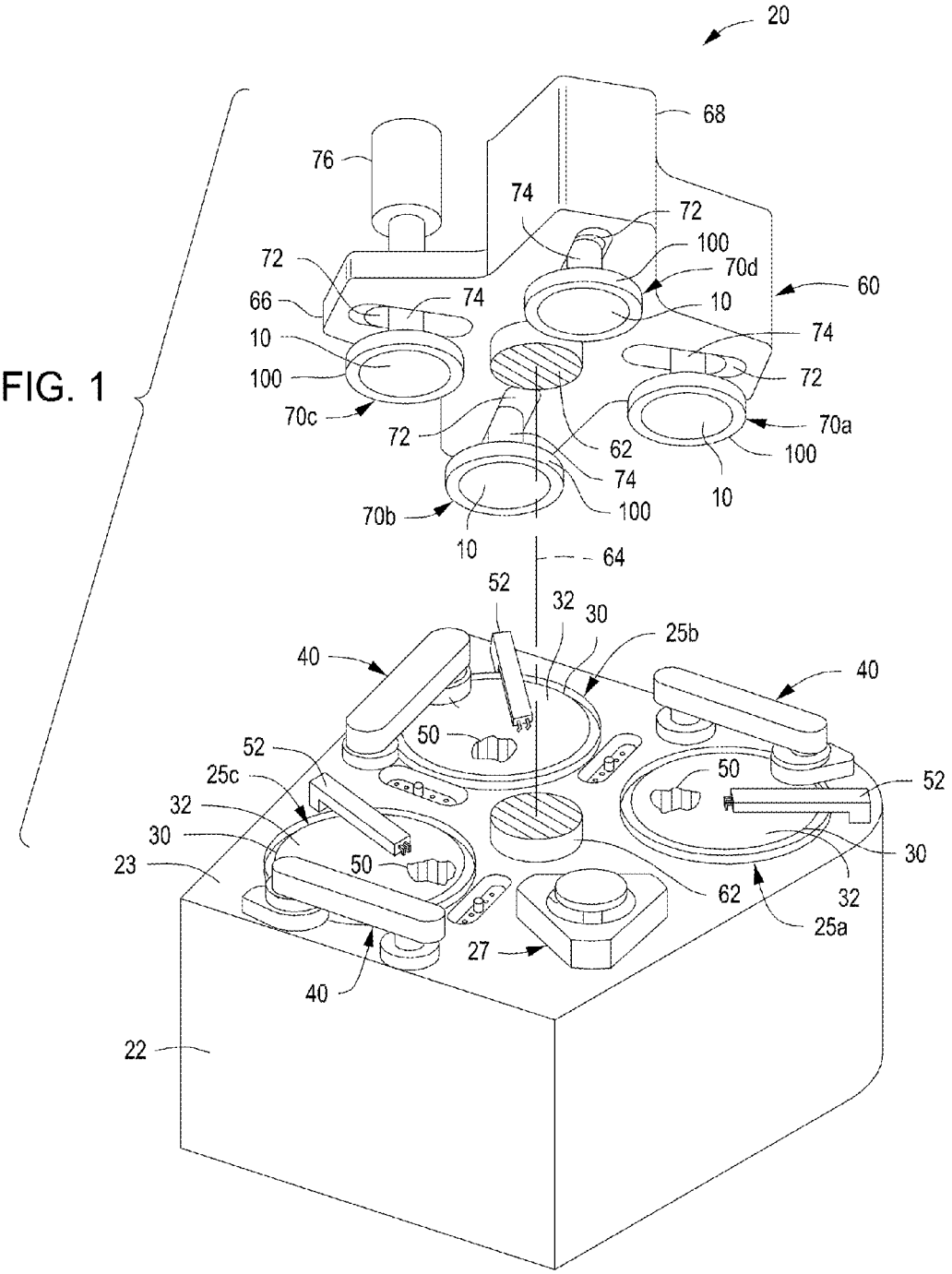
FIG. 1 is an exploded perspective view of a chemical mechanical polishing apparatus in accordance with some embodiments of the present disclosure.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION

Embodiments of the present disclosure include apparatuses and methods that allow detection of endpoint, abnormal conditions, and other diagnostic information in CMP processes. Specifically, acoustical and/or vibrational emission information produced by CMP processes on the substrate is monitored using a CMP retaining ring with an integrated acoustic/vibration sensor 302. In some embodiments the inventive retaining ring with integrated acoustic/vibration sensor 302 will enable real time analysis of the acoustic/vibration signals produced by the CMP processes. Those CMP acoustic/vibration signals can be used for process control, such as for example, endpoint detection, detection of abnormal conditions such as substrate slip, substrate loading and unloading issues, prediction of mechanical performance of the CMP head and other associated mechanical assemblies that are an integral part of CMP polishing, and the like. The recorded acoustic/vibration information may be resolved into an acoustic/vibration signature that is monitored for changes and compared against a library of acoustic/vibration signatures. Characteristic changes in an acoustic frequency spectrum may reveal process endpoints, abnormal conditions, and other diagnostic information. Thus, embodiments consistent with the present disclosure advantageously provide Fault Detection and Classification (FDC) systems and methods are able to continuously monitors equipment parameters against preconfigured limits using statistical analysis techniques to provide proactive and rapid feedback on equipment health. Such FDC systems and methods advantageously eliminate unscheduled downtime, improve tool availability and reduce scrap.

In some embodiments, the CMP acoustic/vibration signals/recordings will be transmitted out of the CMP head using short range wireless method, such as BLUETOOTH or other wireless communication method. In some embodiments sensor electronics can be powered by a rechargeable battery that can be charged constantly during head rotation in polish cycle.

Referring to FIG. 1, one or more substrates 10 will be polished by a chemical mechanical polishing (CMP) apparatus 20. The CMP apparatus 20 includes a lower machine base 22 with a table top 23 is mounted thereon and a removable upper outer cover (not shown). Table top 23 supports a series of polishing stations 25*a*, 25*b* and 25*c*, and a transfer station 27 for loading and unloading the substrates. Transfer station 27 may form a generally square arrangement with the three polishing stations 25*a*, 25*b* and 25*c*.

Each polishing station 25*a*-25*c* includes a rotatable platen 30 on which is placed a polishing pad 32. If substrate 10 is an eight-inch (200 millimeter) or twelve-inch (300 millimeter) diameter disk, then platen 30 and polishing pad 32 will be about twenty or thirty inches in diameter, respectively. Platen 30 may be connected to a platen drive motor (not shown) located inside machine base 22. For most polishing processes, the platen drive motor rotates platen 30 at thirty to two-hundred revolutions per minute, although lower or higher rotational speeds may be used. Each polishing station 25*a*-25*c* may further include an associated pad conditioner apparatus 40 to maintain the abrasive condition of the polishing pad.

A slurry 50 containing a reactive agent (e.g., deionized water for oxide polishing) and a chemically-reactive catalyzer (e.g., potassium hydroxide for oxide polishing) may be supplied to the surface of polishing pad 32 by a combined slurry/rinse arm 52. If polishing pad 32 is a standard pad, slurry 50 may also include abrasive particles (e.g., silicon dioxide for oxide polishing). Typically, sufficient slurry is provided to cover and wet the entire polishing pad 32. Slurry/rinse arm 52 includes several spray nozzles (not shown) which provide a high pressure rinse of polishing pad 32 at the end of each polishing and conditioning cycle.

A rotatable multi-head carousel 60, including a carousel support plate 66 and a cover 68, is positioned above lower machine base 22. Carousel support plate 66 is supported by a center post 62 and rotated thereon about a carousel axis 64 by a carousel motor assembly located within machine base 22. Multi-head carousel 60 includes four carrier head systems 70*a*, 70*b*, 70*c*, and 70*d* mounted on carousel support plate 66 at equal angular intervals about carousel axis 64. Three of the carrier head systems receive and hold substrates and polish them by pressing them against the polishing pads of polishing stations 25*a*-25*c*. One of the carrier head systems receives a substrate from and delivers the substrate to transfer station 27. The carousel motor may orbit carrier head systems 70*a*-70*d*, and the substrates attached thereto, about carousel axis 64 between the polishing stations and the transfer station.

Each carrier head system 70*a*-70*d* includes a polishing or carrier head 100. Each carrier head 100 independently rotates about its own axis, and independently laterally oscillates in a radial slot 72 formed in carousel support plate 66. A carrier drive shaft 74 extends through slot 72 to connect a carrier head rotation motor 76 (shown by the removal of one-quarter of cover 68) to carrier head 100. There is one carrier drive shaft and motor for each head. Each motor and drive shaft may be supported on a slider (not shown) which can be linearly driven along the slot by a radial drive motor to laterally oscillate the carrier head.

During actual polishing, three of the carrier heads, e.g., those of carrier head systems 70*a*-70*c*, are positioned at and above respective polishing stations 25*a*-25*c*. Each carrier head 100 lowers a substrate into contact with a polishing pad 32. Generally, carrier head 100 holds the substrate in position against the polishing pad and distributes a force across the back surface of the substrate. The carrier head also transfers torque from the drive shaft to the substrate.

Figure 2:
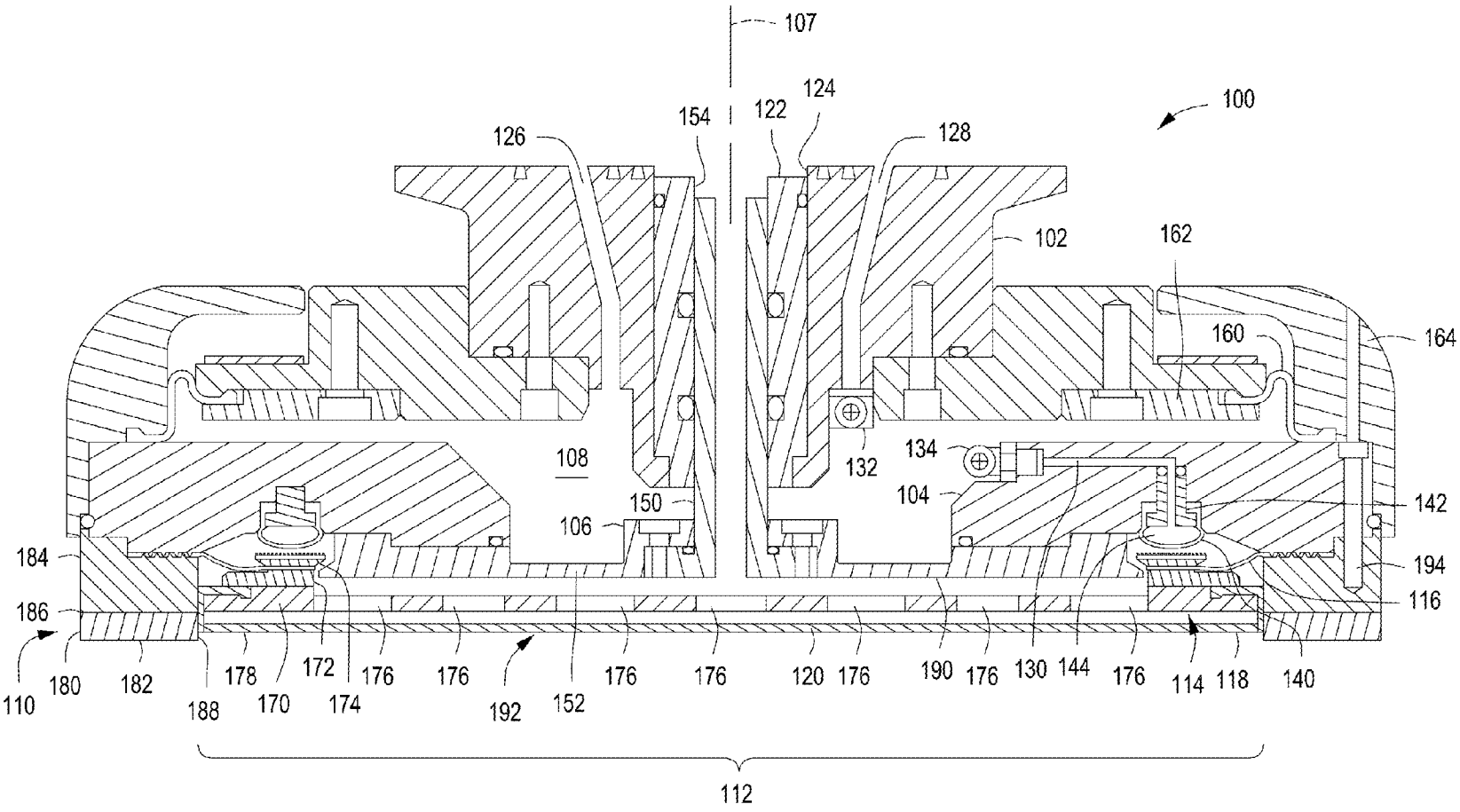
FIG. 2 is a schematic cross-sectional view of a carrier head in accordance with some embodiments of the present disclosure.

Referring to FIG. 2, carrier head 100 includes a housing 102, a base 104, a gimbal mechanism 106, a loading chamber 108, a retaining ring 110, and a substrate backing assembly 112. The housing 102 can be connected to drive shaft 74 to rotate therewith during polishing about an axis of rotation 107 which is substantially perpendicular to the surface of the polishing pad during polishing. The loading chamber 108 is located between housing 102 and base 104 to apply a load, i.e., a downward pressure, to base 104. The vertical position of base 104 relative to polishing pad 32 is also controlled by loading chamber 108.

The substrate backing assembly 112 includes a support structure 114, a flexure diaphragm 116 connecting support structure 114 to base 104, and a flexible member or membrane 118 connected to support structure 114. The flexible membrane 118 extends below support structure 114 to provide a mounting surface 120 for the substrate. Pressurization of a chamber 190 positioned between base 104 and substrate backing assembly 112 forces flexible membrane 118 downwardly to press the substrate against the polishing pad.

The housing 102 is generally circular in shape to correspond to the circular configuration of the substrate to be polished. A cylindrical bushing 122 may fit into a vertical bore 124 extending through the housing, and two passages 126 and 128 may extend through the housing for pneumatic control of the carrier head.

The base 104 is a generally ring-shaped body located beneath housing 102. The base 104 may be formed of a rigid material such as aluminum, stainless steel or fiber-reinforced plastic. A passage 130 may extend through the base, and two fixtures 132 and 134 may provide attachment points to connect a flexible tube between housing 102 and base 104 to fluidly couple passage 128 to passage 130.

An elastic and flexible membrane 140 may be attached to the lower surface of base 104 by a clamp ring 142 to define a bladder 144. Clamp ring 142 may be secured to base 104 by screws or bolts (not shown). A first pump (not shown) may be connected to bladder 144 to direct a fluid, e.g., a gas, such as air, into or out of the bladder and thus control a downward pressure on support structure 114 and flexible membrane 118.

Gimbal mechanism 106 permits base 104 to pivot with respect to housing 102 so that the base may remain substantially parallel with the surface of the polishing pad. Gimbal mechanism 106 includes a gimbal rod 150 which fits into a passage 154 through cylindrical bushing 122 and a flexure ring 152 which is secured to base 104. Gimbal rod 150 may slide vertically along passage 154 to provide vertical motion of base 104, but the Gimbal rod 150 prevents any lateral motion of base 104 with respect to housing 102.

An inner edge of a rolling diaphragm 160 may be clamped to housing 102 by an inner clamp ring 162, and an outer clamp ring 164 may clamp an outer edge of rolling diaphragm 160 to base 104. Thus, rolling diaphragm 160 seals the space between housing 102 and base 104 to define loading chamber 108. Rolling diaphragm 160 may be a generally ring-shaped sixty mil thick silicone sheet. A second pump (not shown) may be fluidly connected to loading chamber 108 to control the pressure in the loading chamber and the load applied to base 104.

The support structure 114 of substrate backing assembly 112 is located below base 104. Support structure 114 includes a support plate 170, an annular lower clamp 172, and an annular upper clamp 174. Support plate 170 may be a generally disk-shaped rigid member with a plurality of apertures 176 therethrough. In addition, support plate 170 may have a downwardly-projecting lip 178 at its outer edge.

Flexure diaphragm 116 of substrate backing assembly 112 is a generally planar annular ring. An inner edge of flexure diaphragm 116 is clamped between base 104 and retaining ring 110, and an outer edge of flexure diaphragm 116 is clamped between lower clamp 172 and upper clamp 174. The flexure diaphragm 116 is flexible and elastic, although the flexure diaphragm 116 could also be rigid in the radial and tangential directions. Flexure diaphragm 116 may formed of rubber, such as neoprene, an elastomeric-coated fabric, such as NYLON or NOMEX, plastic, or a composite material, such as fiberglass.

Flexible membrane 118 is a generally circular sheet formed of a flexible and elastic material, such as chloroprene or ethylene propylene rubber. A portion of flexible membrane 118 extends around the edges of support plate 170 to be clamped between the support plate and lower clamp 172.

The sealed volume between flexible membrane 118, support structure 114, flexure diaphragm 116, base 104, and gimbal mechanism 106 defines pressurizable chamber 190. A third pump (not shown) may be fluidly connected to chamber 190 to control the pressure in the chamber and thus the downward forces of the flexible membrane on the substrate.

Retaining ring 110 may be a generally annular ring secured at the outer edge of base 104, e.g., by bolts 194 (only one is shown in the cross-sectional view of FIG. 2). When fluid is pumped into loading chamber 108 and base 104 is pushed downwardly, retaining ring 110 is also pushed downwardly to apply a load to polishing pad 32. An inner surface 188 of retaining ring 110 defines, in conjunction with mounting surface 120 of flexible membrane 118, a substrate receiving recess 192. The retaining ring 110 prevents the substrate from escaping the substrate receiving recess.

Figure 3:
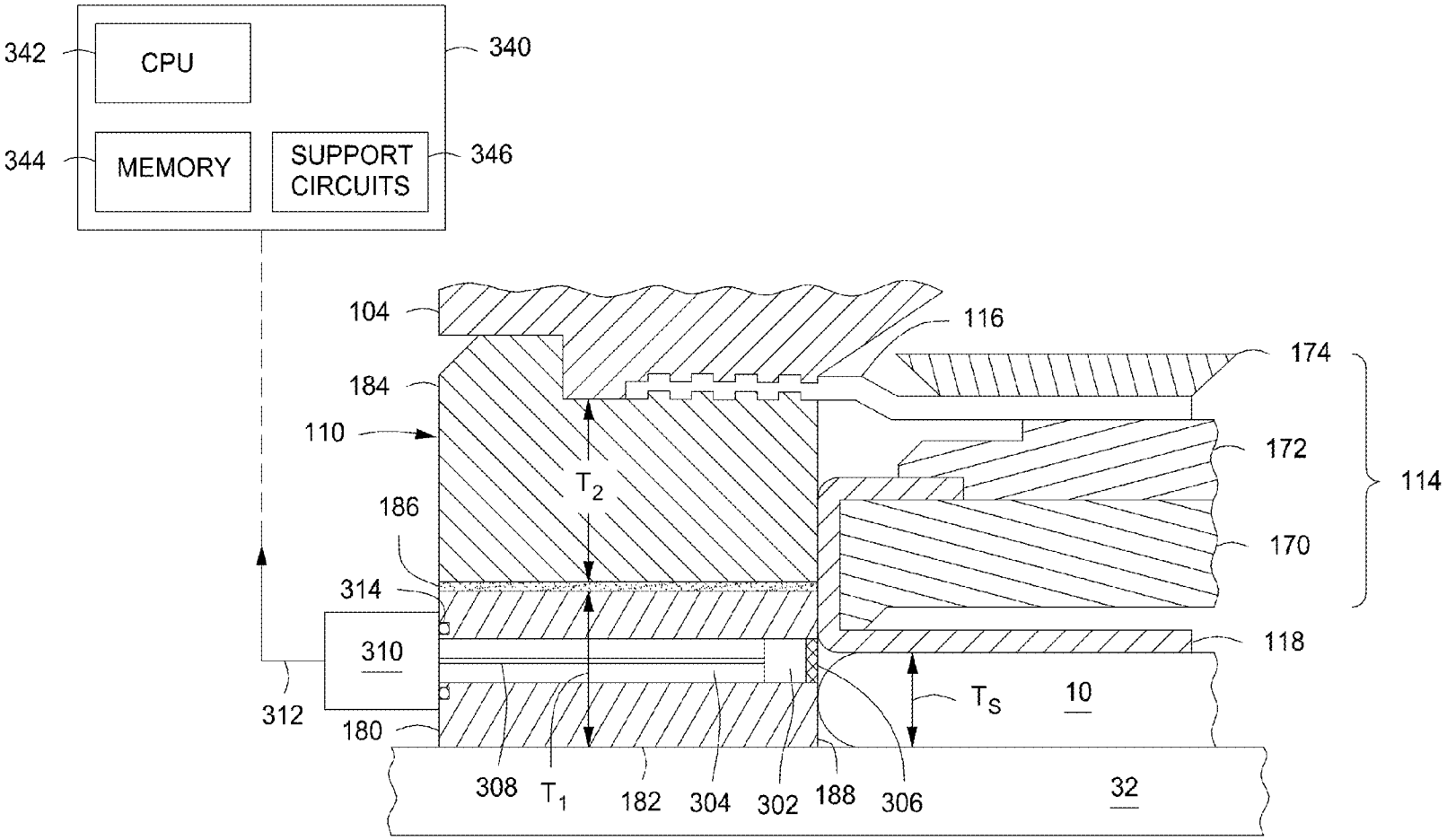
FIG. 3 is an enlarged view of the carrier head of FIG. 2 showing a retaining ring in accordance with some embodiments of the present disclosure.

Referring to FIG. 3, retaining ring 110 includes multiple sections, including an annular lower portion 180 having a bottom surface 182 that may contact the polishing pad, and an annular upper portion 184 connected to base 104. Lower portion 180 may be bonded to upper portion 184 with an adhesive layer 186.

Figure 6:
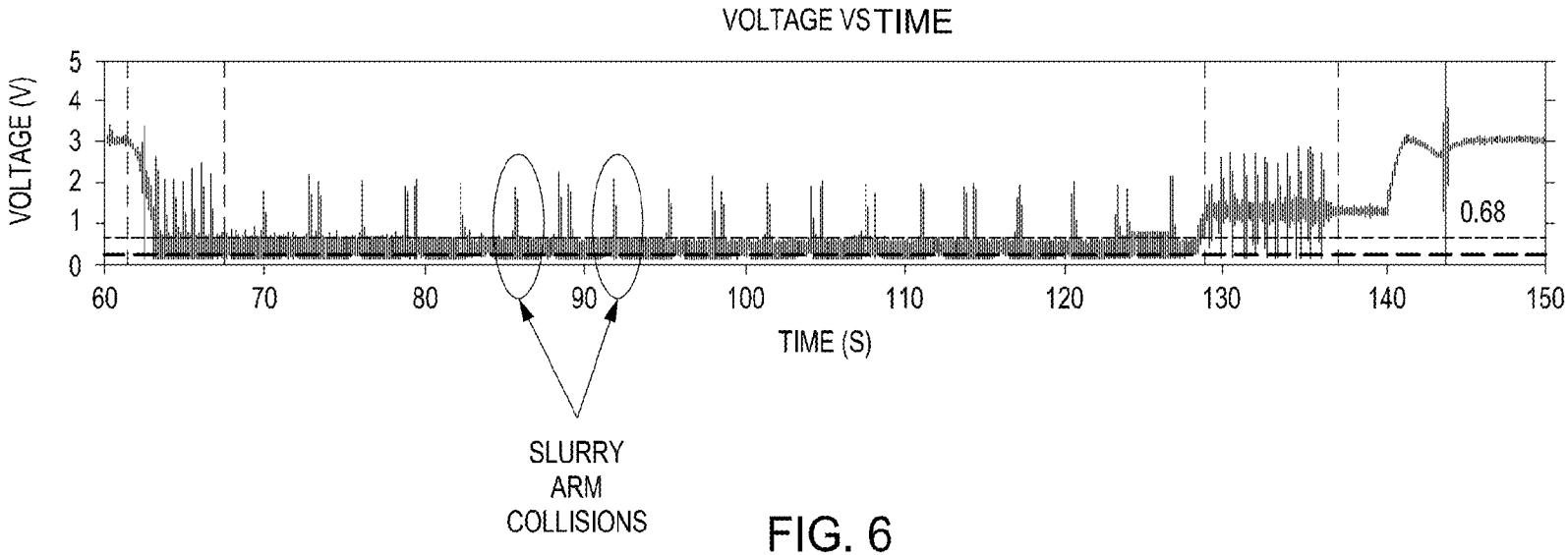
FIG. 6 depicts a graph of voltage vs. time showing a mechanical malfunction detected during a chemical mechanical polishing process in accordance with some embodiments of the present disclosure.

In some embodiments, the retaining ring 110 has a channel 304 in which an acoustic/vibration sensor 302, is disposed therein. In some embodiments, the acoustic/vibration sensor 302 may be a microphone. Other types of acoustic sensors may be used with embodiments consistent with the present disclosure. In some embodiments, the acoustic/vibration sensor 302 may be an accelerometer, such as a micro electro-mechanical systems (MEMS) accelerometer, for detecting/measuring vibrations. In some embodiments, the acoustic/vibration sensor 302 are passive sensors that can perform in-situ detection/measurement of surface acoustic waves (SAW) which are acoustic waves traveling along the surface of a material exhibiting elasticity, with an amplitude that typically decays exponentially with depth into the substrate. In some embodiments, the acoustic/vibration sensor 302 may detect, capture and/or measure both acoustic emissions and vibrations produced from processes performed on the substrate. The acoustical/vibrational emission information produced by CMP processes on the substrate is captured by acoustic/vibration sensor 302. The inventive retaining ring with integrated acoustic/vibration sensor 302 will enable real time analysis of the acoustic signals produced by the CMP processes captured by acoustic/vibration sensor 302. The CMP acoustic/vibration signals captured by acoustic/vibration sensor 302 can be used for process control, such as for example, endpoint detection, detection of abnormal conditions such as wafer slip, substrate loading and unloading issues, prediction of mechanical performance of the CMP head and other associated mechanical assemblies that are an integral part of CMP polishing, and the like. In some embodiments, the captured acoustic/vibration information may be resolved into an acoustic/vibration signature that is monitored for changes and compared against a library of acoustic/vibration signatures. Characteristic changes in an acoustic/vibration frequency spectrum may reveal process endpoints, abnormal conditions, and other diagnostic information. The captured acoustic/vibration information may be analyzed to reveal mechanical malfunctions such as, for example, substrate scratch detection caused by the polishing process, slurry arm and head collisions, head wearout (e.g., seals, gimbal, etc.), faulty bearings, conditioner head actuations, excessive vibrations, and the like. FIG. 6 depicts a graph of voltage vs. time showing a slurry arm collision, for example, detected by the acoustic/vibration sensor 302. The voltage is a measurement of the acoustic/vibration energy emitted from the process being monitored that is detected by the acoustic/vibration sensor 302.

In some embodiments, the acoustic/vibration sensor 302 may include a transducer configured to detect vibrational mechanical energy emitted as polishing pad 32 comes into physical contact and rubs against substrate 10. Acoustic/vibration emission signals received by acoustic/vibration sensor 302 are converted to an electrical signal and then communicated in electronic form via electrical leads 308 to a transmitter 310.

The transmitter 310 may send the acoustic/vibration signals received to a controller/computer 340 for analysis and to control the CMP apparatus 20. In some embodiments, the transmitter 310 may be a wireless transmitter having a transmission antennae 312. Thus, in some embodiments, the CMP acoustic/vibration signals detected by acoustic/vibration sensor 302 will be transmitted out of the CMP head using short range wireless method, such as BLUETOOTH, Radio-frequency identification (RFID) signaling and standards, Near field communication (NFC) signaling and standards, Institute of Electrical and Electronics Engineers' (IEEE) 802.11x or 802.16x signaling and standards, or other wireless communication method via transmitter 310. A receiver will receive the signals which will be analyzed as discussed above. In some embodiments sensor electronics can be powered by a rechargeable battery that can be charged constantly during head rotation in polish cycle.

The controller/computer 340 may be one or more computers systems communicatively coupled together for analyzing information transmitted by transmitter 310 associated with the captured acoustic/vibration emissions captured by acoustic/vibration sensor 302. The controller/computer 340 generally comprises a central processing unit (CPU) 342, a memory 344, and support circuits 346 for the CPU 342 and facilitates the determination of CMP processing conditions (i.e., process end points, abnormal conditions, etc.), and control of the components of CMP apparatus 20 based on the CMP process conditions determined.

To facilitate control of the CMP apparatus 20 as described above, the controller/computer 340 may be one of any form of general-purpose computer processor that can be used in an industrial setting for controlling various CMP apparatus and sub-processors. The memory 344, or computer-readable medium, of the CPU 342 may be one or more of readily available memory such as random access memory (RAM), read only memory (ROM), floppy disk, hard disk, or any other form of digital storage, local or remote. The support circuits 346 are coupled to the CPU 342 for supporting the processor in a conventional manner. These circuits include cache, power supplies, clock circuits, input/output circuitry and subsystems, and the like. The inventive methods described herein are generally stored in the memory 344 as a software routine. The software routine may also be stored and/or executed by a second CPU (not shown) that is remotely located from the hardware being controlled by the CPU 342.

In some embodiments, the transmitter 310 may be coupled to the outer surface of retaining ring 110. A seal 314 may be disposed between transmitter 310 and the outer radial surface of retaining ring 110 to seal the outermost diameter opening of channel 304.

A seal 306 may be disposed along the innermost diameter of the channel 304 to separate the acoustic/vibration sensor 302 from the CMP process environment. The seal 306 prevents CMP processing materials and environmental conditions from entering the channel 304, while providing a high level of acoustic/vibration conductivity. In some embodiments, the seal 306 may be press fit into channel 304 and may be pushed like a plunger towards the innermost diameter of the channel 304. In some embodiments, the seal 306 may be a silicon membrane. In other embodiments, the seal 306 may be a portion of the retaining ring 110 wall that has not been drilled or machined. The seal 306 may be about 1 mm to about 10 mm thick. In some embodiments, the acoustic/vibration sensor 302 may include a humidity or pressure sensor to detect if seal 306 has failed/ruptured. In other embodiments, an analysis of acoustic/vibration signals detected by acoustic/vibration sensor 302 may be used to determine if seal 306 has failed.

Figure 4:
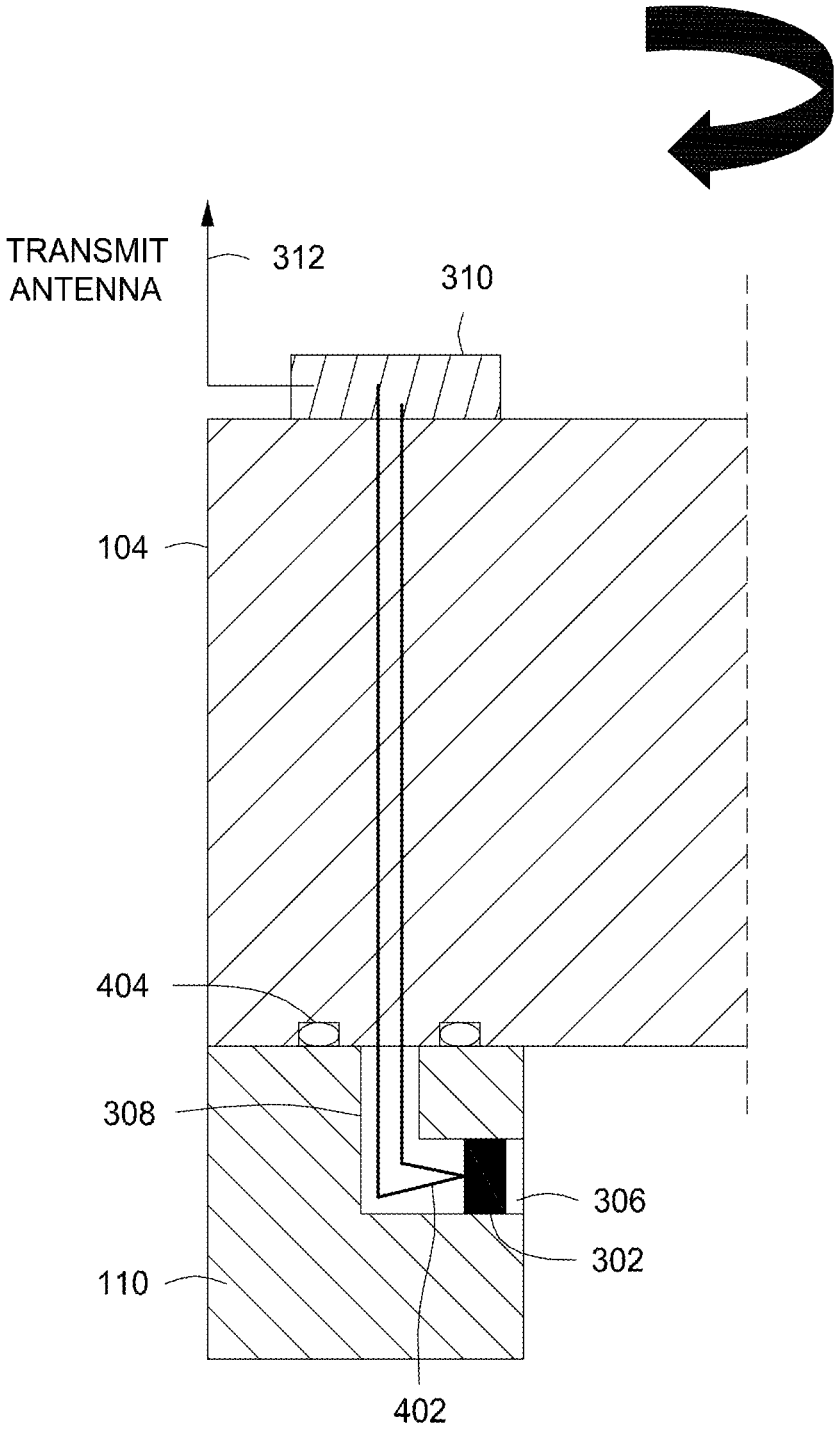
FIG. 4 is a schematic view of a retaining ring in accordance with some embodiments of the present disclosure.

In some embodiments, the channel 304 may be gun drilled or otherwise machined to accommodate acoustic/vibration sensor 302. As shown in FIG. 3, in some embodiments, the channel 304 may be disposed entirely within the retaining ring 110. The channel 304 may extend from an outer surface of the retaining ring 110 to an inner surface (e.g., inner surface 188) of retaining ring 110 proximate the central opening. In some embodiments, the channel 304 may be disposed entirely within the annular lower portion 180, the annular upper portion 184, or a combination of both. FIG. 4 depicts at least one other embodiment where the channel 402 is disposed in retaining ring 110 and base 104 with electrical leads 308 attached to transmitter 310 disposed on an upper surface of base 104. In FIG. 4, seal 404 is disposed about the channel 402 and electrical leads 308 at the intersection of base 104 and retaining ring 110.

Figure 5:
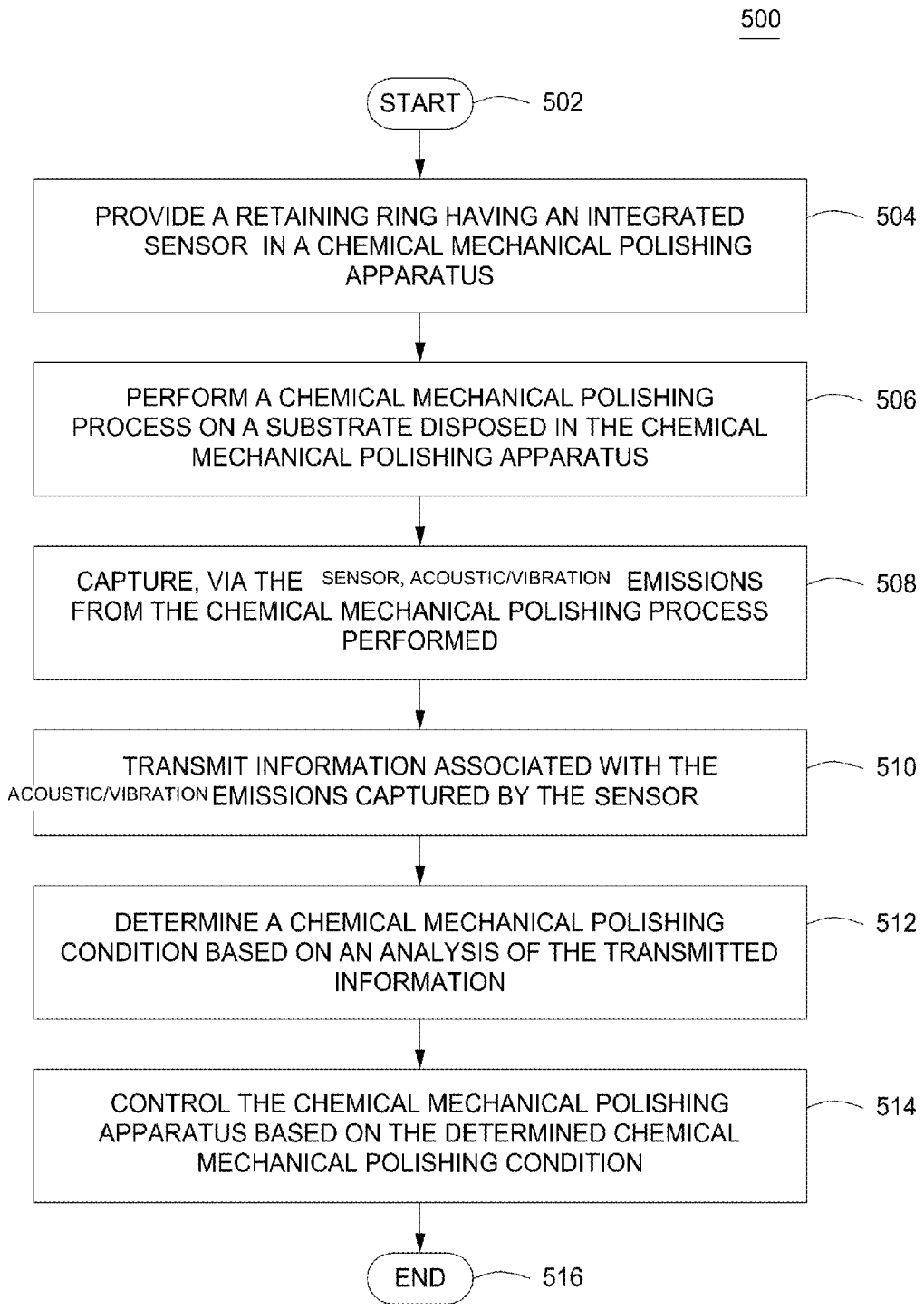
FIG. 5 is a flow chart for a method for determining chemical mechanical polishing conditions in accordance with some embodiments of the present disclosure.

In operation, embodiments of the present disclosure may be used to determine chemical mechanical polishing conditions as described with respect to method 500 in FIG. 5. The method 500 begins at 502 and proceeds to 504 where a retaining ring 110 having an integrated acoustic/vibration sensor 302 is provided in a chemical mechanical polishing apparatus 20. At 506, a chemical mechanical polishing process may be performed on a substrate 10 disposed in the chemical mechanical polishing apparatus 20. In some embodiments, the chemical mechanical polishing process may include a polishing process, a substrate loading or unloading process, a cleaning process, and the like.

The method 500 proceeds to 508 where the acoustic/vibration sensor 302 embedded in the retaining ring 110 captures acoustic/vibration emissions from the chemical mechanical polishing process performed.

At 510, information associated with the acoustic/vibration emissions captured by the acoustic/vibration sensor 302 is transmitted by transmitter 310. In some embodiments, the information associated with the acoustic/vibration emissions is wirelessly transmitted by transmitter 310 to a controller/computer 340.

At 512, one or more chemical mechanical polishing conditions are determined based on an analysis of the transmitted information. For example, in some embodiments, the conditions determined may include CMP process endpoint detection, detection of abnormal conditions such as substrate slip, substrate loading and unloading issues, mechanical performance conditions of the CMP head and other associated mechanical assemblies that are an integral part of CMP polishing, and the like. In some embodiments, the controller/computer 340 may analyze the information transmitted by transmitter 310 to determine the one or more CMP process conditions.

At 514, the chemical mechanical polishing apparatus may be controlled by controller/computer 340 based on the determined chemical mechanical polishing conditions. The method 500 ends at 516.

Referring to FIG. 3, the lower portion 180 is formed of a material which is chemically inert in a CMP process. In addition, lower portion 180 should be sufficiently elastic that contact of the substrate edge against the retaining ring does not cause the substrate to chip or crack. On the other hand, lower portion 180 should not be so elastic that downward pressure on the retaining ring causes lower portion 180 to extrude into substrate receiving recess 192. Specifically, the material of the lower portion 180 may have a durometer measurement of about 80-95 on the Shore D scale. In general, the elastic modulus of the material of lower portion 180 may be in the range of about 0.3-1.0 106 psi. The lower portion should also be durable and have a low wear rate. However, it is acceptable for lower portion 180 to be gradually worn away, as this appears to prevent the substrate edge from cutting a deep grove into inner surface 188. For example, lower portion 180 may be made of a plastic, such as polyphenylene sulfide (PPS), available from DSM Engineering Plastics of Evansville, Ind., under the trade name Techtron™. Other plastics, such as DELRIN™, available from Dupont of Wilmington, Del., polyethylene terephthalate (PET), polyetheretherketone (PEEK), or polybutylene terephthalate (PBT), or a composite material such as ZYMAXX™, also available from Dupont, may be suitable.

The thickness T1 of lower portion 180 should be larger than the thickness TS of substrate 10. Specifically, the lower portion should be thick enough that the substrate does not brush against the adhesive layer when the substrate is chucked by the carrier head. On the other hand, if the lower portion is too thick, the bottom surface of the retaining ring will be subject to deformation due to the flexible nature of the lower portion. The initial thickness of lower portion 180 may be about 200 to 400 mils (with grooves having a depth of 100 to 300 mils). The lower portion may be replaced when the grooves have been worn away. Thus, the thickness T1 of lower portion 180 may vary between about 400 mils (assuming an initial thickness of 400 mils) and about 100 mils (assuming that grooves 300 mils deep were worn away). If the retaining ring does not include grooves, the lower portion may be replaced when the thickness of the lower portion of the retaining ring is equal to the substrate thickness.

The bottom surface of the lower portion 180 may be substantially flat, or the bottom surface may have a plurality of channels or grooves 196 (shown in phantom in FIG. 3) to facilitate the transport of slurry from outside the retaining ring to the substrate.

The upper portion 184 of retaining ring 110 is formed of a rigid material, such as a metal, e.g., stainless steel, molybdenum, or aluminum, or a ceramic, e.g., alumina, or other exemplary materials. The material of the upper portion may have an elastic modulus of about 10-50 106 psi, i.e., about ten to one hundred times the elastic modulus of the material of the lower portion. For example, the elastic modulus of the lower portion may be about 0.6 106 psi, the elastic modulus of the upper portion may be about 30 106 psi, so that the ratio is about 50:1. The thickness T2 of upper portion 184 should be greater than the thickness T1 of lower portion 180. Specifically, the upper portion may have a thickness T2 of about 300-500 mils.

The adhesive layer 186 may be a two-part slow-curing epoxy. Slow curing generally indicates that the epoxy takes on the order of several hours to several days to set. The epoxy may be Magnobond-6375™, available from Magnolia Plastics of Chamblee, Ga. Alternately, instead of being adhesively attached, the lower layer may be connected with screws or press-fit to the upper portion.

The flatness of the bottom surface of the retaining ring has a bearing on the edge effect. Specifically, if the bottom surface is very flat, the edge effect is reduced. If the retaining ring is relatively flexible, the retaining ring can be deformed where the retaining ring is joined to the base, e.g., by bolts 194. This deformation creates a non-planar bottom surface, thus increasing the edge effect. Although the retaining ring can be lapped or machined after installation on the carrier head, lapping tends to embed debris in the bottom surface which can damage the substrate or contaminate the CMP process, and machining is time-consuming and inconvenient. On the other hand, an entirely rigid retaining ring, such as a stainless steel ring, can cause the substrate to crack or contaminate the CMP process.

With the retaining ring of the present disclosure, the rigidity of upper portion 184 of retaining ring 110 increases the overall flexural rigidity of the retaining ring, e.g., by a factor of 30-40 times, as compared to a retaining ring formed entirely of a flexible material such as PPS. The increased rigidity provided by the rigid upper portion reduces or eliminates this deformation caused by the attachment of the retaining ring to the base, thus reducing the edge effect. Furthermore, the retaining ring need not be lapped after the retaining ring is secured to the carrier head. In addition, the PPS lower portion is inert in the CMP process, and is sufficiently elastic to prevent chipping or cracking of the substrate edge.

Another benefit of the increased rigidity of the retaining ring of the present disclosure is that the increased rigidity of the retaining ring reduces the sensitivity of the polishing process to pad compressibility. Without being limited to any particular theory, one possible contribution to the edge effect, particularly for flexible retaining rings, is what may be termed "deflection" of the retaining ring. Specifically, the force of the substrate edge on the inner surface of the retaining ring at the trailing edge of the carrier head may cause the retaining ring to deflect, i.e., locally twist slightly about an axis parallel to the surface of the polishing pad. This forces the inner diameter of the retaining ring more deeply into the polishing pad, generates increased pressure on the polishing pad, and causes the polishing pad material to "flow" and be displaced toward the edge of the substrate. The displacement of the polishing pad material depends upon the elastic properties of the polishing pad. Thus, a relatively flexible retaining ring which can deflect into the pad, makes the polishing process extremely sensitive to the elastic properties of the pad material. However, the increased rigidity provided by the rigid upper portion decreases the deflection of the retaining ring, thus reducing pad deformation, sensitivity to pad compressibility, and the edge effect.

Although the embodiments described above focus on a retaining ring with a acoustic/vibration sensor 302 embedded therein for CMP processes, the same design may be used for edge rings and the like in substrate processing chambers. In addition, some embodiments may include one or more acoustic/vibration sensors 302 disposed in various parts of a substrate processing chamber to detect various processing conditions from different vantage points, creating a "smart chamber."

While the foregoing is directed to embodiments of the present disclosure, other and further embodiments of the disclosure may be devised without departing from the basic scope thereof.

The invention claimed is:

1. A retaining ring for a carrier head having a mounting surface for a substrate comprising:

an annular body having a central opening;

a channel formed in the body, wherein a first end of the channel is proximate the central opening; and a sensor disposed within the channel and proximate the first end, wherein the sensor is configured to detect acoustic and/or vibration emissions from processes performed on the substrate.

2. The retaining ring of claim 1, further comprising:

a seal disposed within the channel between the sensor and the central opening.

3. The retaining ring of claim 2, wherein the seal is a silicon membrane separating the central opening from the sensor.

4. The retaining ring of claim 2, wherein the channel extends from an outer surface of the retaining ring to an inner surface of the retaining ring proximate the central opening.

5. The retaining ring of claim 2, wherein the seal is about 1 mm to about 10 mm thick.

6. The retaining ring of claim 2, further comprising:

a second sensor to detect if the seal has failed, wherein the second sensor is one of a humidity sensor or a pressure sensor.

7. The retaining ring of claim 1, wherein the sensor is one of a microphone to detect acoustic emissions from processes performed on the substrate, or a micro electro-mechanical systems (MEMS) accelerometer to detect vibrations produced from processes performed on the substrate.

8. The retaining ring of claim 1, wherein the sensor is coupled to a transmitter via one or more electrical leads.

9. The retaining ring of claim 8, wherein the transmitter is a wireless transmitter configured to wirelessly transmit information associated with acoustic and/or vibration emissions obtained from the sensor.

10. The retaining ring of claim 8, wherein the transmitter is disposed on an outer surface of the retaining ring.

11. A carrier head for a chemical mechanical polishing apparatus, comprising:

a base;

a retaining ring connected to the base, wherein the retaining ring comprises:

an annular body having a central opening, a channel formed in the body, wherein a first end of the channel is proximate the central opening, and a sensor disposed within the channel and proximate the first end, wherein the sensor is configured to detect acoustic and/or vibration emissions from chemical mechanical polishing processes;

a support structure connected to the base by a flexure to be moveable independently of the base and the retaining ring; and a flexible membrane that defines a boundary of a pressurizable chamber, the membrane connected to the support structure and having a mounting surface for a substrate.

12. The carrier head of claim 11, wherein the retaining ring further includes a seal disposed within the channel between the sensor and the central opening.

13. The carrier head of claim 12, wherein the seal is a silicon membrane separating the central opening from the sensor.

14. The carrier head of claim 12, wherein the channel extends from an outer surface of the retaining ring to an inner surface of the retaining ring proximate the central opening.

15. The carrier head of claim 12, wherein the seal is about 1 mm to about 10 mm thick.

16. The carrier head of claim 11, wherein sensor is coupled to a transmitter via one or more electrical leads.

17. The retaining ring of claim 16, wherein the transmitter is a wireless transmitter configured to wirelessly transmit information associated with acoustic and/or vibration emissions obtained from the sensor.

18. The retaining ring of claim 16, wherein the transmitter is disposed on an outer surface of the base.

* * * * *